US011339795B2

(12) United States Patent
Saka

(10) Patent No.: US 11,339,795 B2
(45) Date of Patent: May 24, 2022

(54) AIR BLOWER

(71) Applicant: MINEBEA MITSUMI Inc., Nagano (JP)

(72) Inventor: Yoshikazu Saka, Kitasaku-gun (JP)

(73) Assignee: MINEBEA MITSUMI Inc., Nagano (JP)

( * ) Notice: Subject to any disclaimer, the term of this patent is extended or adjusted under 35 U.S.C. 154(b) by 0 days.

(21) Appl. No.: 16/649,349

(22) PCT Filed: Jan. 28, 2019

(86) PCT No.: PCT/JP2019/002764
§ 371 (c)(1),
(2) Date: Mar. 20, 2020

(87) PCT Pub. No.: WO2019/181208
PCT Pub. Date: Sep. 26, 2019

(65) Prior Publication Data

US 2021/0364010 A1 Nov. 25, 2021

(30) Foreign Application Priority Data

Mar. 20, 2018 (JP) ..... JP2018-052088

(51) Int. Cl.
*F04D 29/28* (2006.01)
*F04D 29/30* (2006.01)
(Continued)

(52) U.S. Cl.
CPC ..... *F04D 29/30* (2013.01); *F04D 29/281* (2013.01); *F04D 29/4226* (2013.01); *F04D 29/441* (2013.01)

(58) Field of Classification Search
CPC ..... F04D 29/281; F04D 29/30; F04D 29/441; F04D 29/582
See application file for complete search history.

(56) References Cited

U.S. PATENT DOCUMENTS

2011/0116928 A1* 5/2011 Czulak ..... H02K 9/06 416/95
2013/0094954 A1* 4/2013 Ishii ..... F04D 25/082 415/206
2014/0147728 A1 5/2014 Reitzle et al.

FOREIGN PATENT DOCUMENTS

CN 102062120 A 5/2011
CN 102959251 A 3/2013
(Continued)

OTHER PUBLICATIONS

Office Action dated Sep. 27, 2021 for corresponding Japanese Application No. 2018-052088 and English translation.
(Continued)

*Primary Examiner* — Sabbir Hasan
(74) *Attorney, Agent, or Firm* — Pearne & Gordon LLP

(57) ABSTRACT

An air blower enabling efficient cooling is provided. The air blower (1) includes: an impeller (3); and a motor (5), wherein the impeller (3) includes a plurality of first blades (32) and a cup (33) arranged at the inner periphery side d of the plurality of first blades (32), the motor (5) includes a housing (51) arranged inside the cup (33), a stator (73), and a rotor (52) arranged inside the stator, and an outer peripheral surface (41*c*) of the cup (33) is provided with an opening part (43) facing an outer peripheral surface (51*c*) of the housing (51).

8 Claims, 7 Drawing Sheets

(51) Int. Cl.
*F04D 29/42* (2006.01)
*F04D 29/44* (2006.01)

(56) References Cited

FOREIGN PATENT DOCUMENTS

| | | | |
|---|---|---|---|
| CN | 203879808 | U | 10/2014 |
| JP | 06-294399 | A | 10/1994 |
| JP | 2000-050602 | A | 2/2000 |
| JP | 2003-214386 | A | 7/2003 |
| JP | 2006-298180 | A | 11/2006 |
| JP | 2012-013035 | A | 1/2012 |
| JP | 2013-106411 | A | 5/2013 |

OTHER PUBLICATIONS

English translation of the Written Opinion for corresponding International Application No. PCT/JP2019/002764 dated Apr. 23, 2019.
International Preliminary Report on Patentability for corresponding International Application No. PCT/JP2019/002764 dated Sep. 22, 2020.
International Search Report for corresponding International Application No. PCT/JP2019/002764 dated Apr. 23, 2019.
Written Opinion for corresponding International Application No. PCT/JP2019/002764 dated Apr. 23, 2019.
First Office Action dated Oct. 20, 2021 for corresponding Chinese Application No. 201980004759.8 and English translation.
Notice of Reasons for Refusal dated Dec. 6, 2021 for corresponding Japanese Application No. 2018-052088 and English translation.
Notice of Reasons for Refusal dated Apr. 4, 2022 for corresponding Japanese Application No. 2018-052088 and English translation.

* cited by examiner

AIR BLOWER

TECHNICAL FIELD

The present invention relates to an air blower.

BACKGROUND ART

Conventionally, as an air blower, there is known an air blower including a main fan sucking air into the air blower, an auxiliary fan attached to the main fan, and a fan motor rotating the main fan and the auxiliary fan (see Patent Literature 1).

In this air blower, multiple air-hole parts are formed in the main fan, and by rotation of the auxiliary fan attached to a side opposite to the fan motor side, air flowing around the fan motor is sucked through the air-hole parts to increase a flow rate and cool the fan motor.

DOCUMENT LIST

Patent Literature

Patent Literature 1: Japanese Patent Application Publication No. 06-294399

SUMMARY OF INVENTION

Technical Problem

In the air blower as described above, it is required to rotate the main fan and the auxiliary fan at a high speed to further cool the fan motor, and the fan motor may end up becoming heated. Thus, there has been a need for a structure of the air blower enabling efficient cooling.

The present invention has been made in view of the above problem, and an object of the present invention is to provide an air blower enabling efficient cooling.

Solution to Problem

To achieve the above object, the air blower according to the present invention includes an impeller; and a motor, wherein the impeller includes a plurality of blades and a cup arranged inside the plurality of blades, the motor includes a housing arranged inside the cup, a stator, and a rotor arranged inside the stator, and an outer peripheral surface of the cup is provided with an opening part facing an outer peripheral surface of the housing.

In the air blower according one aspect of the present invention, a space is formed between the cup and the housing in a radial direction, and the opening part makes a space between the cup and the plurality of blades communicate with the space between the cup and the housing.

In the air blower according to the aspect of the present invention, the plurality of blades are first blades, the cup is provided with a second blade, and the second blade extends in a radial direction from an inner peripheral surface of the cup toward the housing.

In the air blower according to one aspect of the present invention, the cup includes a plurality of opening parts including the opening part, and the plurality of openings parts are arranged in a circumferential direction.

In the air blower according to one aspect of the present invention, the cup includes a plurality of second blades including the second blade, and the plurality of second blades are adjacent to the plurality of respective opening parts.

In the air blower according to one aspect of the present invention, the cup is provided with an end surface facing the housing in a rotational axis direction, an opening part is formed in the end surface, and the opening part in the end surface is continuous with the opening part formed in the outer peripheral surface of the cup.

In the air blower according to one aspect of the present invention, the opening part is formed in the outer peripheral surface of the cup continuously from an end surface facing the housing to a bottom surface.

With the air blower according to the present invention, it is possible to cool the motor.

DESCRIPTION OF EMBODIMENTS

Hereinafter, embodiments of the present invention will be explained in detail with reference to the drawings.

[Overall Configuration of Air Blower]

Figure 1:
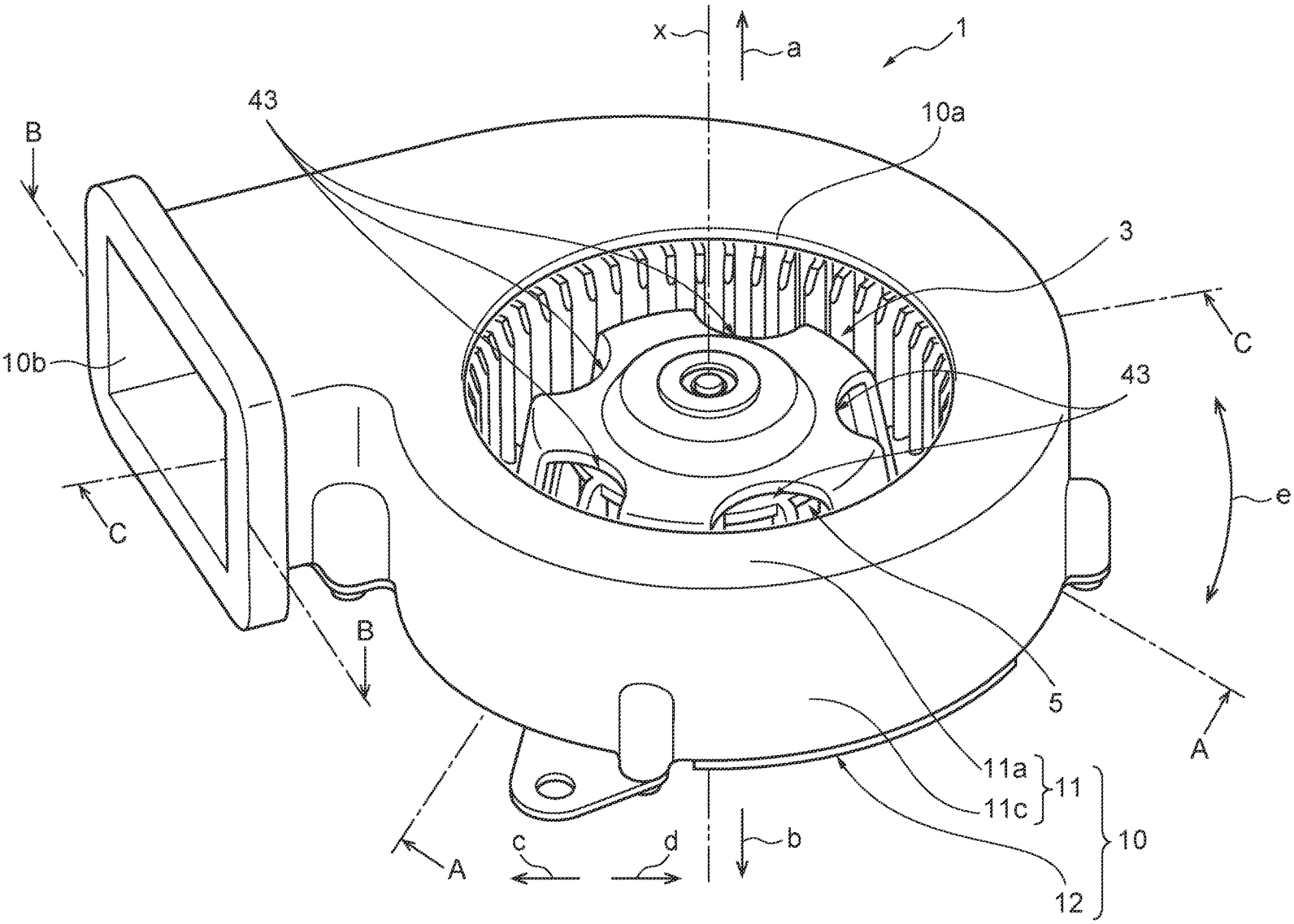
FIG. 1 A perspective view schematically illustrating a configuration of an air blower according to an embodiment of the present invention.
Figure 2:
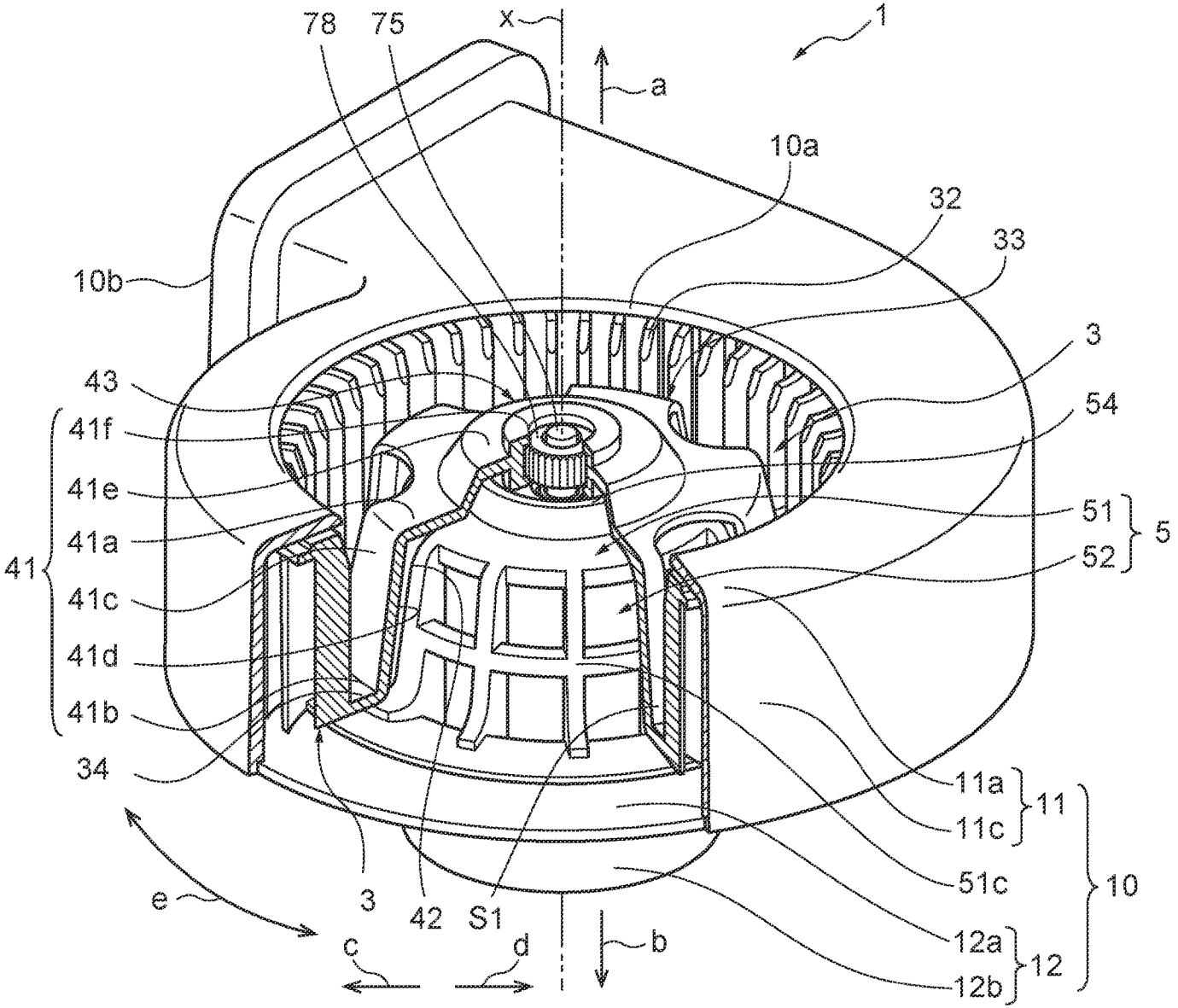
FIG. 2 An A-A sectional view of FIG. 1 schematically illustrating the configuration of the air blower according to the embodiment of the present invention.

First, a configuration of an air blower according to an embodiment of the present invention will be explained with reference to FIG. 1. FIG. 1 is a perspective view schematically illustrating the configuration of the air blower 1 according to the embodiment of the present invention. FIG. 2 is a sectional view of a section along the A-A line in FIG. 1.

Hereinafter, for the convenience of explanation, an arrow a direction in a rotational axis x direction is defined as an upper side a, and an arrow b direction is defined as a lower side b. Also, in a direction perpendicular to the rotational axis x (hereinafter may be referred to as a "radial direction"), a direction away from the rotational axis x (an arrow c direction in FIG. 1) is defined as an outer periphery side c, and a direction toward the rotational axis x (an arrow d direction in FIG. 1) is defined as an inner periphery side d. Further, a circumferential direction around the rotational axis x (an arrow e direction in FIG. 1) is defined as a circumferential direction e.

As shown in FIG. 1 and FIG. 2, the air blower 1 according to the embodiment of the present invention includes an impeller 3 rotating counterclockwise around the rotational axis x, and a motor 5 causing the impeller 3 to rotate. The impeller 3 and the motor 5 are accommodated inside a case 10.

The case 10 includes an accommodating part 11 covering the impeller 3, and a bottom part 12 arranged at the lower side b of the accommodating part 11.

The accommodating part 11 includes a top wall part 11*a* having an opening formed at the upper side a, and a side wall part 11*c* surrounding the outer periphery side c of the impeller 3 along an outer periphery part of the top wall part 11*a*. The top wall part 11*a* forms a wall part projecting radially inward from the side wall part 11*c*.

As shown in FIG. 2, the bottom part 12 includes a support part 12*a* formed of a plate-like member in an annular shape and supports a housing 51 of the motor 5 (described later), and a cover part 12*b* arranged at the lower side b of the support part 12*a* and covers the lower side b of the motor 5. The accommodating part 11 and the bottom part 12 are coupled with joint members such as screws.

As shown in FIG. 1, the opening in the top wall part 11*a* serves as an inlet port 10*a* having a circular shape and sucking air. Also, the case 10 includes an outlet port 10*b* formed of a portion of the accommodating part 11 extended toward the outer periphery side c and a portion of the bottom part 12 extended toward the outer periphery side c and discharges air.

[Configuration of Impeller]

Figure 3:
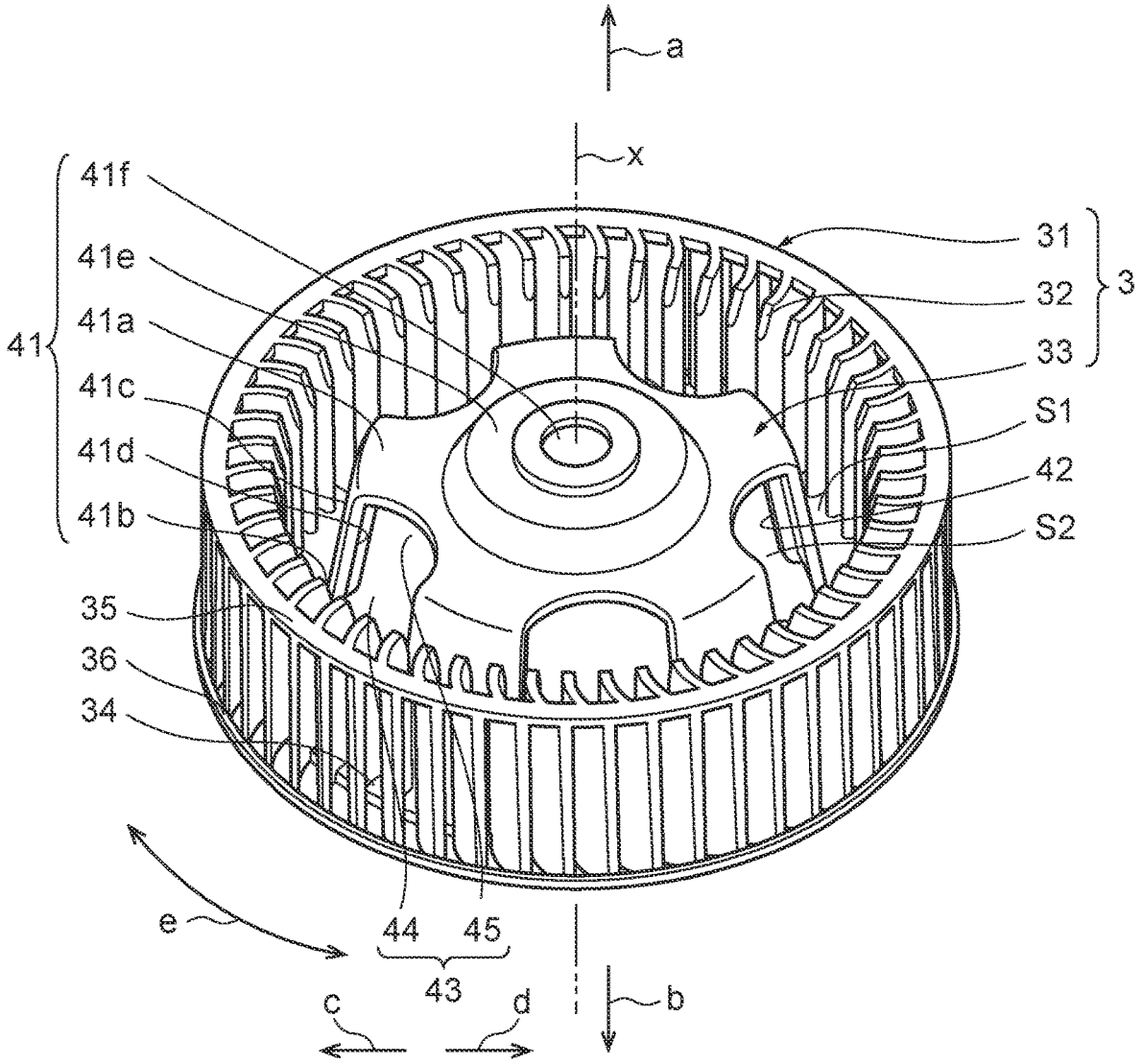
FIG. 3 A perspective view schematically illustrating a configuration of an impeller of the air blower according to the embodiment of the present invention.
Figure 4:
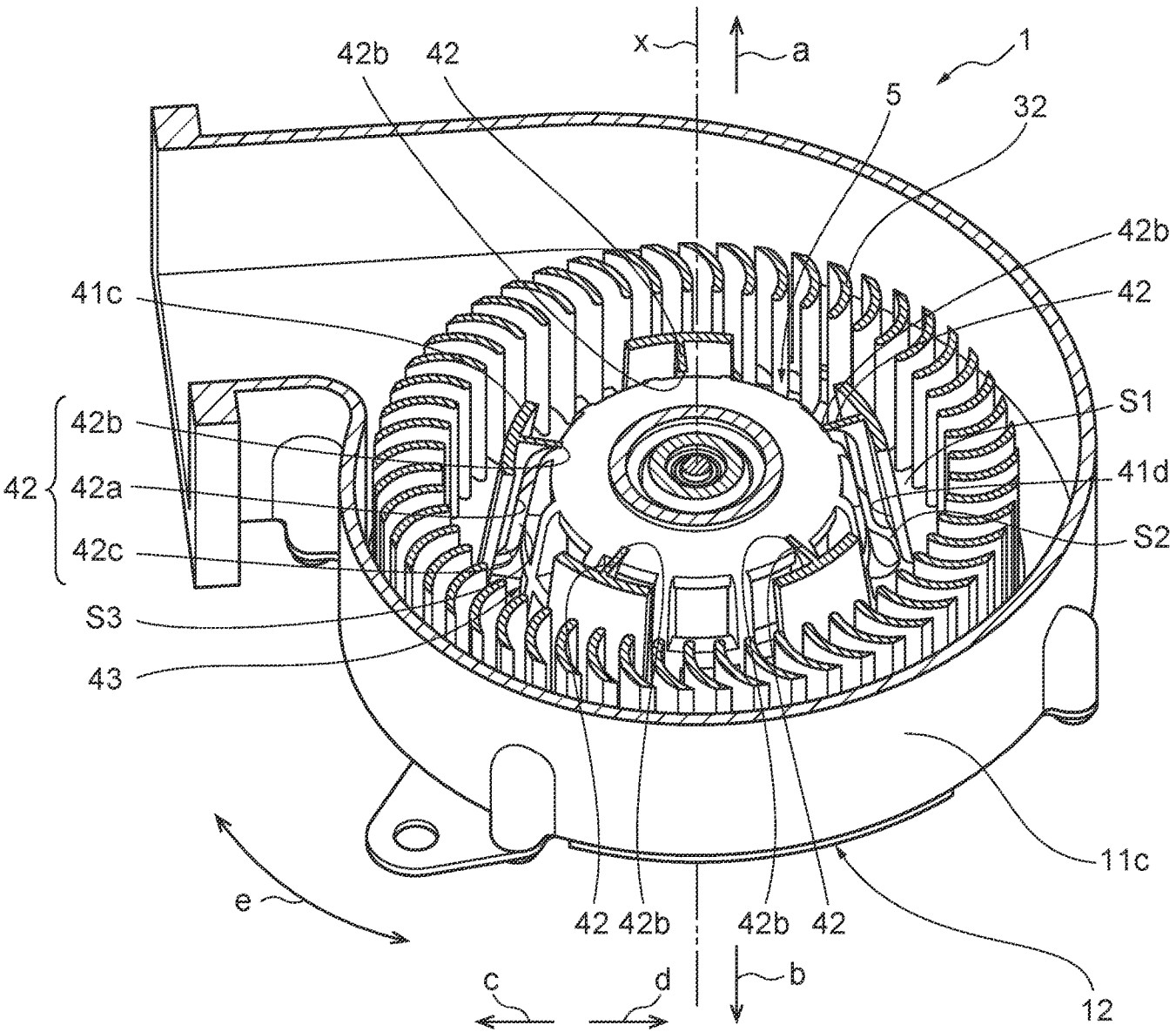
FIG. 4 A B-B sectional view of FIG. 1 schematically illustrating the configuration of the impeller of the air blower according to the embodiment of the present invention.

Then, referring to FIGS. 2 to 4, a configuration of the impeller 3 will be explained. FIG. 3 is a perspective view schematically illustrating the configuration of the impeller 3. FIG. 4 is a sectional view of a section along the B-B line in FIG. 1.

As shown in FIG. 3, the impeller 3 includes an impeller body 31, multiple first blades 32 arranged at an inner peripheral surface of the impeller body 31 at equal intervals along the circumferential direction e of the rotational axis x, and a cup 33 arranged further toward the inside d of the multiple first blades 32. Between the cup 33 and the housing 51 (described later), there are formed a space S1 and a space S2. The space S1 and the space S2 are formed in an annular shape in the circumferential direction e.

The impeller body 31 has a disk-like shape centered about the rotational axis x, and includes a base 34 arranged at the lower side b of the cup 33, an upper frame 35 arranged at the upper side a of the base 34, and a bottom frame 36 arranged at the outer periphery side c of the base 34.

The first blades 32 extend from the outer periphery side c toward the inner periphery side d, and are arranged between the upper frame 35 and the base 34 or the bottom frame 36. Specifically, at the upper side a in the rotational axis x direction, portions of the respective first blades 32 at the outer periphery side c are connected to the upper frame 35 of the impeller body 31. Also, at the lower side b in the rotational axis x direction, portions of the respective first blades 32 at the outer periphery side c are connected to the bottom frame 36 of the impeller body 31, and portions of the respective first blades 32 at the inner periphery side d are connected to the base 34 of the impeller body 31. In other words, the first blades 32 are formed extending from the upper frame 35 to the bottom frame 36 of the impeller body 31 in the rotational axis x direction.

As shown in FIG. 2, the cup 33 includes an accommodating part 41 in a cup shape covering the upper side a of the housing 51 (described later) in the rotational axis x direction, and second blades 42 extending from an inner peripheral surface 41*d* of the accommodating part 41 facing the inner periphery side d toward the housing 51 and project so as not to contact an outer peripheral surface 51*c* of the housing 51. In other words, the cup 33 is provided with the second blades 42, and the second blades 42 extends radially from the inner peripheral surface 41*d* of the cup 33 toward the housing 51. The cup 33 includes the multiple second blades 42, and the multiple second blades 42 are adjacent to respective multiple opening parts 43 (described later).

As shown in FIG. 3, the accommodating part 41 is provided with the opening parts 43 making the space S1 formed between the cup 33 and the multiple first blades 32 communicate with the space S2 formed between the cup 33 and the housing 51 (described later). In the circumferential direction e, multiple gaps S3 each being a portion of the space S2 are formed between the cup 33 and the housing 51 (described later). When viewed from the upper side in the rotational axis x direction, the accommodating part 41 has a planar shape formed by cutting out semicircular or substantially semicircular end surface opening parts 45 (described later) from a circular shape or a substantially circular shape.

The accommodating part 41 includes an upper end surface 41*a* being a surface at the upper side a, a lower end surface 41*b* being a surface at the lower side b, an outer peripheral surface 41*c* between the upper end surface 41*a* and the lower end surface 41*b* and facing the multiple first blades 32, and an inner peripheral surface 41*d* between the upper end surface 41*a* and the lower end surface 41*b* and facing the housing 51 (described later) of the motor 5.

The accommodating part 41 also includes a projection part 41*e* and a hole part 41*f*. The projection part 41*e* projects toward the upper side a farther than the upper end surface 41*a* and holds a shaft 75 (see FIG. 5) and a fixing part 78 (see FIG. 5) inside the projection part 41*e*. The shaft 75 penetrates the hole part 41*f*. These projection part 41*e* and hole part 41*f* are arranged at the upper side a and the outer periphery side c of the housing 51 (described later) in the rotational axis x direction.

In the rotational axis x direction, the height of the accommodating part 41 from the upper end surface 41*a* to the lower end surface 41*b* is smaller than the height of the impeller body 31 and the first blades 32. Also, as shown in FIG. 2, the lower end surface 41*b* of the accommodating part 41 in the rotational axis x direction is connected to the base 34 of the impeller body 31, and the accommodating part 41 is rotatable about the rotational axis x integrally with the impeller body 31 and the multiple first blades 32.

As shown in FIG. 3, multiple (five in the embodiment of the present invention) opening parts 43 of the accommodating part 41 are arranged at equal intervals along the circumferential direction e of the rotational axis x, and provided in the outer peripheral surface 41*c* and the upper end surface 41*a* of the accommodating part 41. Each opening part 43 includes an opening part (hereinafter referred to as an outer peripheral opening part) 44 formed in the outer peripheral surface 41*c* of the accommodating part 41 and faces the outer peripheral surface 51*c* of the housing 51 (described later), and an opening part (hereinafter referred to as an end surface opening part) 45 formed in the upper end surface 41*a* facing the housing 51 (described later), and the outer peripheral opening part 44 and the end surface opening part 45 are spatially continuous.

Multiple (five in the embodiment of the present invention) outer peripheral opening parts 44 are formed at equal intervals in the outer peripheral surface 41*c* of the accommodating part 41. Specifically, the outer peripheral opening parts 44 are each formed in a rectangular shape or a substantially rectangular shape in the outer peripheral surface 41*c* of the accommodating part 41 from the upper end surface 41*a* to the lower end surface 41*b*. In other words, the outer peripheral opening parts 44 extend from the upper end surface 41*a* to the lower end surface 41*b* in the rotational axis x direction and provide communication between the space S1 between the cup 33 and the multiple first blades 32 and the space S2 between the cup 33 and the housing 51 (described later). Portions of the housing 51 and the rotor 52 (described later) are exposed through the outer peripheral opening parts 44.

Multiple (five in the embodiment of the present invention) end surface opening parts 45 are formed at equal intervals along the circumferential direction e of the upper end surface 41*a* of the accommodating part 41. Specifically, the end surface opening parts 45 are each formed in a semicircular shape when viewed from the upper side a in the rotational axis x direction, and opened toward the upper side a in the rotational axis x direction.

Also, since the height from the upper end surface 41*a* to the lower end surface 41*b* of the accommodating part 41 formed with the end surface opening parts 45 is smaller than the height of the impeller body 31 and the first blades 32 in the rotational axis x direction, the end surface opening parts 45 are opened toward the upper side a in the space S1. Portions of the housing 51 and the rotor 52 (described later) are exposed to the space S1 through these end surface opening parts 45.

The outer peripheral opening part 44 and the end surface opening part 45 of each opening part 43 are formed spatially continuously. In other words, the opening part 43 is an opening formed continuously from the upper end surface 41*a* to the lower end surface 41*b*, and portions of the housing 51 and the rotor 52 (described later) are exposed through the opening parts 43.

As shown in FIG. 4, the second blades 42 provided to the accommodating part 41 of the cup 33 each include an intermediate part 42*a* arranged at the inner peripheral surface 41*d* side of the accommodating part 41 in the rotational axis x direction so as to extend along the rotational axis x, an end part (hereinafter referred to as an upper side tip end part) 42*b* extending from the upper side a of the intermediate part 42*a* toward the housing 51 (described later), and an end part (hereinafter referred to as a lower side rounded end part) 42*c* provided at the lower side b of the intermediate part 42*a*.

Also, each second blade 42 is formed from the upper end surface 41*a* to the lower end surface 41*b* of the accommodating part 41 between the adjacent opening parts 43, and the intermediate part 42*a*, the upper side tip end part 42*b*, and the lower side rounded end part 42*c* each projecting toward the inner periphery side d are arranged with a gap S3 from the outer peripheral surface 51*c* of the housing 51. Specifically, each second blade 42 is curved from the upper side tip end part 42*b* toward the intermediate part 42*a*, and formed in a shape conforming to the outer peripheral surface 51*c* of the housing 51 with a certain distance kept between the outer peripheral surface 51*c* of the housing 51 and the second blade 42 throughout its upper side tip end part 42*b*, intermediate part 42*a*, and lower side rounded end part 42*c*. In other words, the gap S3 is a portion of the space S2 at which the radial width of the space S2 is reduced by a projecting amount of the second blade 42 from the inner peripheral surface 41*d* of the accommodating part 41 to the inner periphery side d.

[Configuration of Motor]

Figure 5:
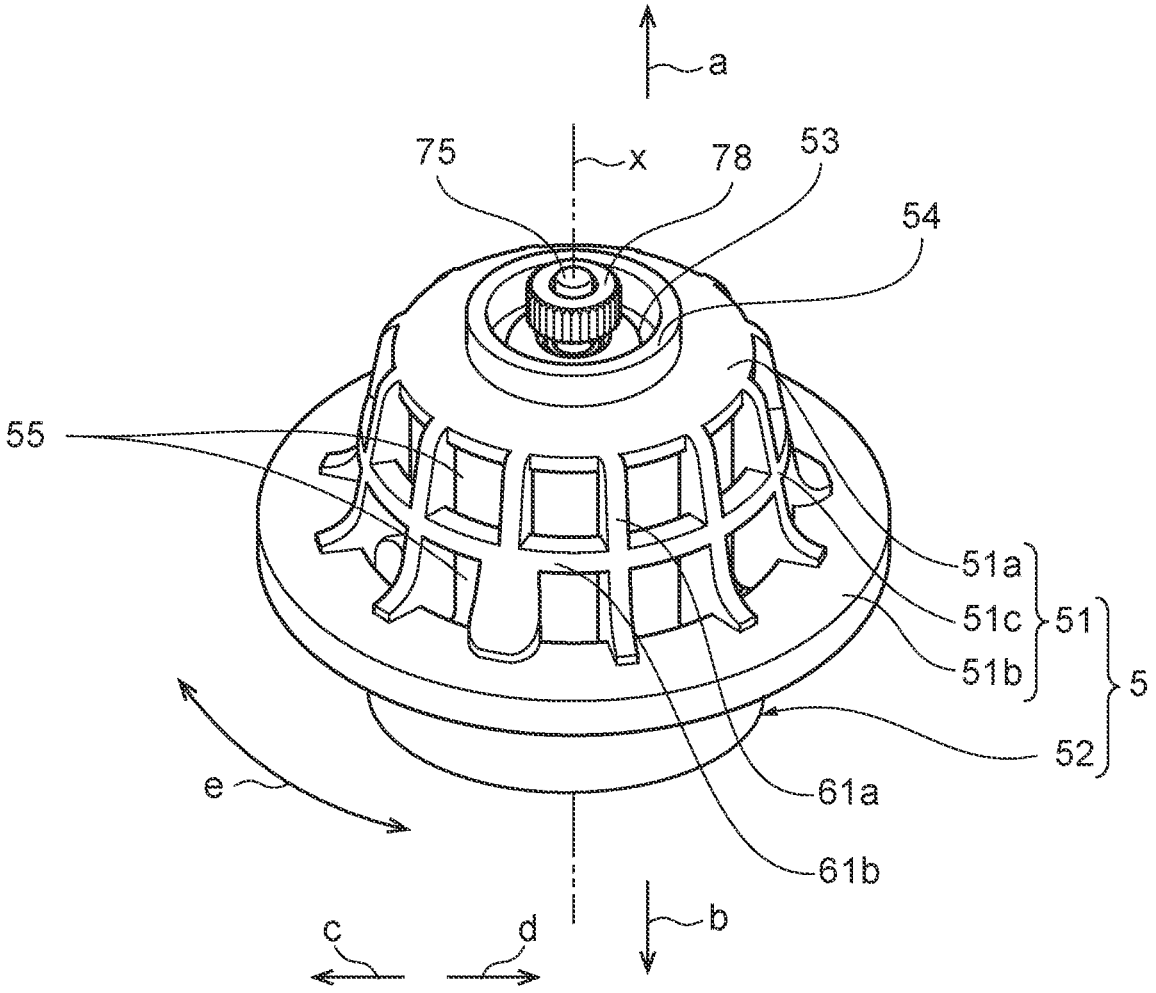
FIG. 5 A perspective view schematically illustrating a configuration of a housing of the air blower according to the embodiment of the present invention.
Figure 6:
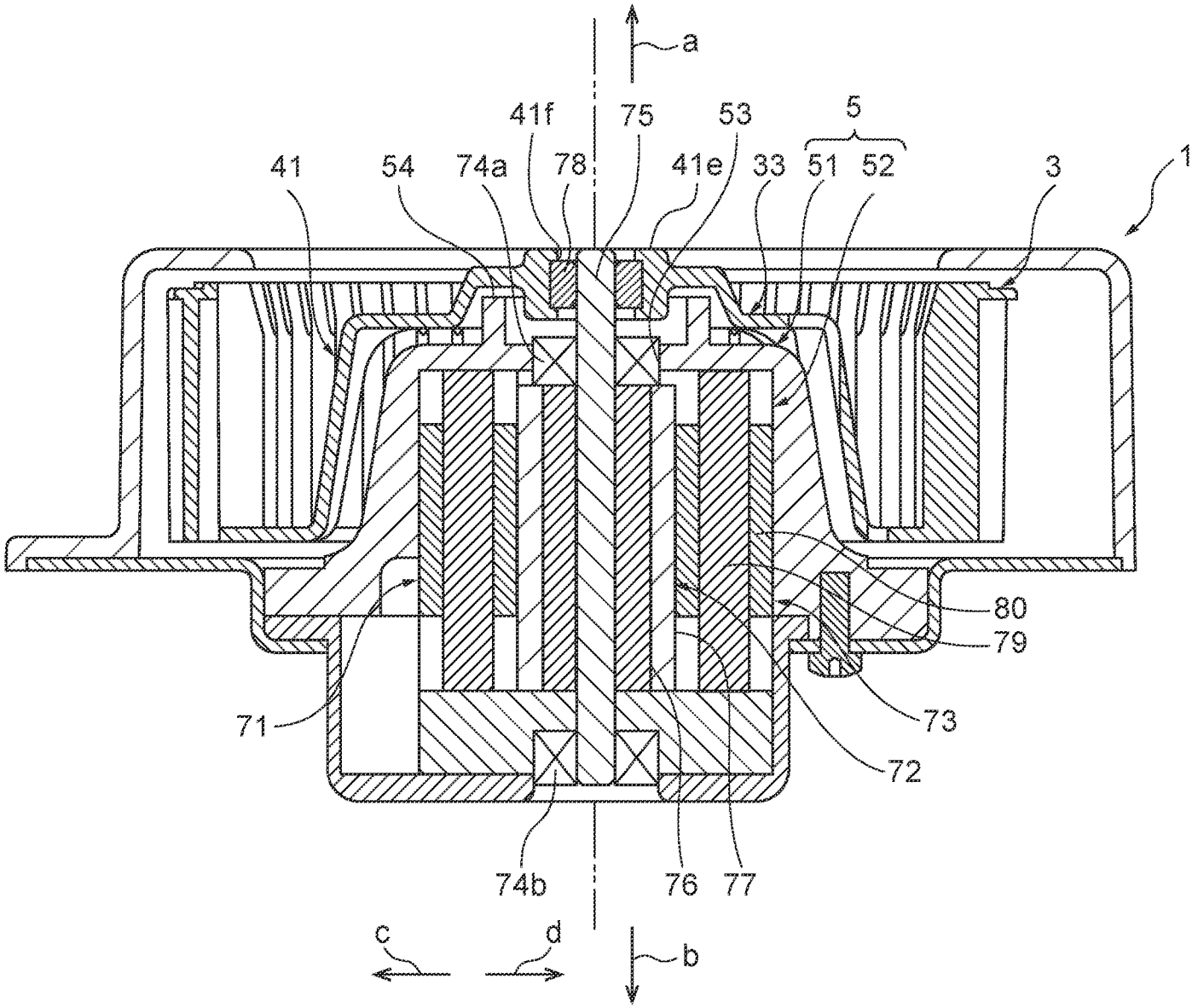
FIG. 6 A C-C sectional view of FIG. 1 schematically illustrating a configuration of an inner motor of the air blower according to the embodiment of the present invention.

Then, a configuration of the motor 5 will be explained with reference to FIG. 5 and FIG. 6. FIG. 5 is a perspective view schematically illustrating a configuration of the housing 51 of the motor 5. FIG. 6 is a sectional view of a section along the C-C line of FIG. 1, schematically illustrating a configuration of the rotor 52 of the motor 5.

As shown in FIG. 5 and FIG. 6, the motor 5 includes the housing 51 arranged inside the accommodating part 41 (see FIG. 2) of the cup 33, a stator 73, and the rotor 52 arranged inside the stator 73. The rotor 52 is arranged inside the stator.

As shown in FIG. 5, the housing 51 includes an upper end surface 51*a* being a surface at the upper side a in the rotational axis x direction, a lower end surface 51*b* being a surface at the lower side b, and an outer peripheral surface 51*c* between the upper end surface 51*a* and the lower end surface 51*b*. A portion of the rotor 52 at the upper side a in the rotational axis x direction is accommodated inside the housing 51.

The upper end surface 51*a* of the housing 51 is provided with a hole part 53 in a circular shape, the shaft 75 of the rotor 52 (described later) passing through the hole part 53, and a projection part 54 in an annular shape projecting from the upper end surface 51*a* in the rotational axis x direction. The hole part 53 and the projection part 54 provided to the housing 51 are accommodated in the projection part 41*e* of the accommodating part 41 (see FIG. 2). Also, the fixing part 78 of the rotor 52 (described later) is arranged at the inside d of the projection part 54 of the housing 51 (see FIG. 2).

In the rotational axis x direction, an outer peripheral part of the lower end surface 51*b* projects toward the outer periphery side c farther than the upper end surface 51*a* and is supported by the support part 12*a* of the case 10 from the lower side b (see FIG. 2).

In the outer peripheral surface 51*c* of the housing 51, multiple hole parts 55 in a rectangular shape are formed, a portion of the rotor 52 being exposed through the hole parts 55. Specifically, the multiple hole parts 55 are formed in a lattice shape by arranging multiple vertical frames 61*a* provided between the upper end surface 51*a* and the lower end surface 51*b* in the rotational axis x direction and multiple horizontal frames 61*b* provided in the middle or substantially in the middle of the upper end surface 51*a* and the lower end surface 51*b*. The horizontal frames 61*b* extend in a direction intersecting the rotational axis x direction and intersect the vertical frames 61*a*. A portion of the rotor 52 is exposed through the multiple hole parts 55 to the space S2 between the cup 33 and the housing 51.

As shown in FIG. 6, the rotor 52 includes a frame 71 in a cylindrical shape, an inner rotor 72 rotatably supported by bearings 74*a*, 74*b* (described later) in the frame 71, and the stator 73 surrounding the inner rotor 72.

The frame 71 includes, inside thereof, the bearing 74*a* rotatably supporting a portion of the inner rotor 72 at the upper side in the rotational axis x direction, and the bearing 74*b* rotatably supporting a portion of the inner rotor 72 at the lower side b in the rotational axis x direction.

The inner rotor 72 includes a shaft 75 projecting from a portion of the frame 71 at the upper side in the rotational axis x direction, a core 76 formed in an annular shape so as to surround the shaft 75, and a magnet 77 formed in an annular shape so as to surround a surface of the core 76 at the outer periphery side c. A portion of the shaft 75 at the upper side a penetrates the hole part 53 of the housing 51 and the hole part 41*f* of the accommodating part 41.

Also, the upper side a of the shaft 75 is provided with the fixing part 78 formed in an annular shape so as to surround an outer peripheral surface of the shaft 75 and for fixing the impeller 3. In the radial direction, the fixing part 78 is arranged at the inner periphery side d of the projection part 54 of the housing 51 and at the inside of the projection part 41*e* of the accommodating part 41.

The stator 73 includes a stator core 79 formed in an annular shape so as to surround the inner rotor 72, a coil 80, and an insulator (not shown in the figure) insulating the stator core 79 from the coil 80. The coil 80 is wound around teeth (not shown in the figure) of the stator core 79, and the teeth extend in a direction from the stator core 79 toward the inner rotor 72.

[Flow of Wind by Air Blower]

Figure 7:
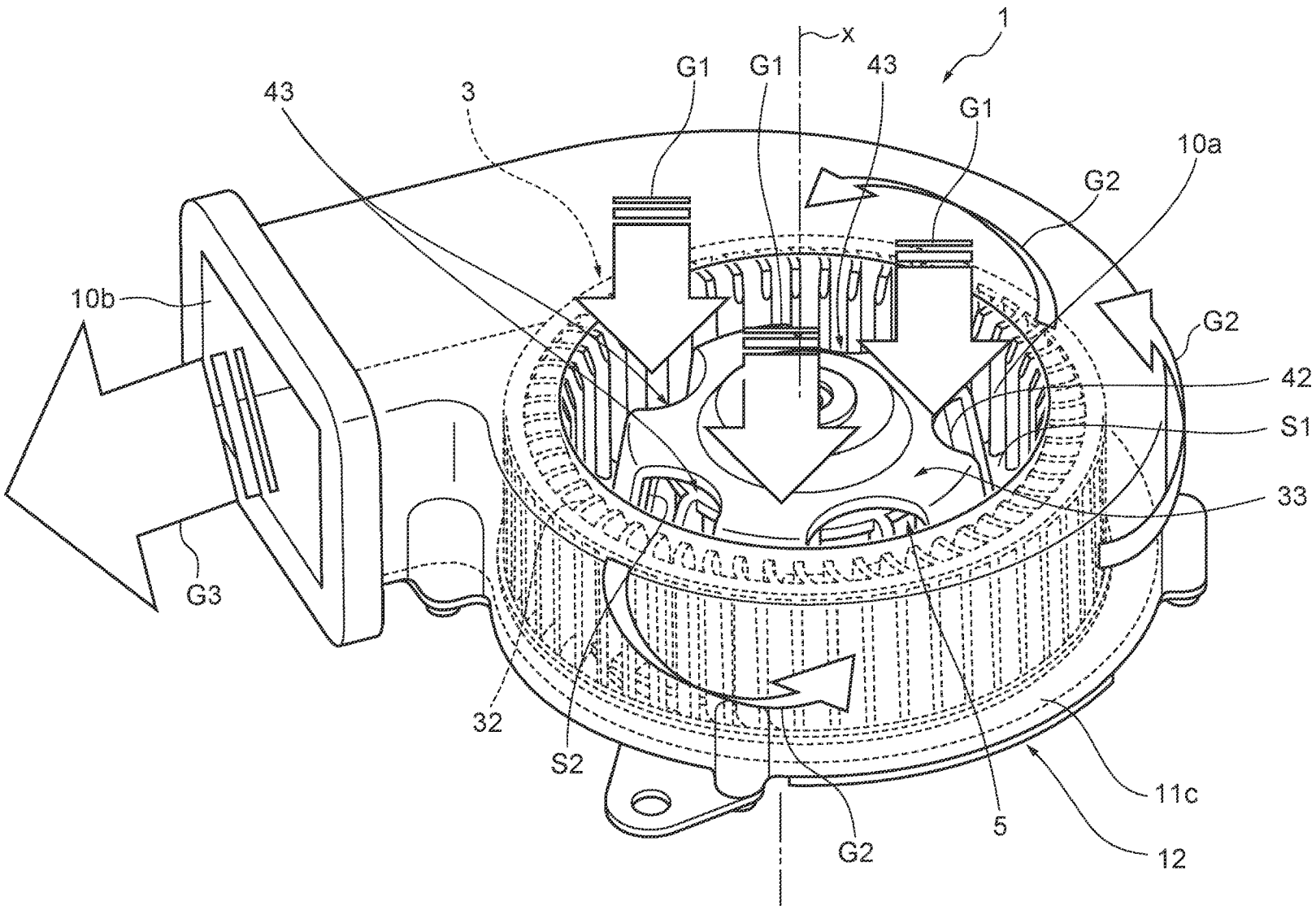
FIG. 7 A perspective view diagrammatically illustrating a flow of wind in the air blower according to the embodiment of the present invention.

Then, a flow of wind by the air blower 1 will be explained with reference to FIG. 7. FIG. 7 is a perspective view diagrammatically illustrating a flow of wind by the air blower 1.

As shown in FIG. 7, when the motor 5 causes the shaft 75 to rotate counterclockwise about the rotational axis x, air around the inlet port 10*a* is introduced in an arrow G1 direction by rotation of the impeller 3 fixed to the fixing part 78 of the shaft 75. In other words, an air current is produced by the first blades 32 of the impeller 3 in the space S1 between the cup 33 and the multiple first blades 32, and the air around the inlet port 10*a* is introduced in the arrow G1 direction.

The air introduced from the inlet port 10*a* flows into the inside of the cup 33 from the outer peripheral opening parts 44 or the end surface opening parts 45 of the respective opening parts 43 while circulating in the space S1. In other words, a portion of the air introduced from the inlet port 10*a* flows into the space S2 between the cup 33 and the housing 51 from the space S1 between the cup 33 and the multiple first blades 32 and through the opening parts 43.

The air having flowed into the inside of the cup 33 flows in an arrow G2 direction along with rotation of the cup 33 of the impeller 3. In particular, since the cup 33 is provided with the second blades 42, the air having flowed into the space S2 increases its flow strength in the arrow G2 direction and the flow rate increases.

Then, the air having flowed into the space S2 circulates in the space S2 or is guided in the vicinity of the outlet port 10*b* in an arrow G3 direction to be discharged.

Thus, since the outer peripheral surface 41*c* of the accommodating part 41 in the air blower 1 is formed with the opening parts 43 making the space S1 between the cup 33 and the multiple first blades 32 communicate with the space S2 between the cup 33 and the housing 51, it is possible to easily and efficiently cool the motor 5 arranged inside the accommodating part 41.

In other words, since the air introduced into the space S1 between the cup 33 and the multiple first blades 32 flows through the opening parts 43 into the space S2 around the motor 5 and circulates in the space S2, it is possible to efficiently cool the motor 5.

Also, the cup 33 is provided with the second blades 42 extending from the inner peripheral surface 41*d* of the accommodating part 41 toward the housing 51. For this reason, the air introduced into the space S2 increases its flow strength in the arrow G2 direction and the flow rate increases. Accordingly, it is possible to efficiently cool the motor 5.

Further, since the second blades 42 are provided in the impeller 3, the second blades 42 also serve as ribs, and this makes it possible to significantly increase the strength of the cup 33.

Further, since the opening parts 43 of the accommodating part 41 each include the outer peripheral opening part 44 formed in the outer peripheral surface 41*c* of the accommodating part 41 and the end surface opening part 45 formed in the upper end surface 41*a* of the accommodating part 41 and the opening parts 43 are each formed continuously from the upper end surface 41*a* to the lower end surface 41*b*, it is possible to easily produce the air current from the arrow G2 direction to the arrow G3 direction and thus to efficiently cool the motor 5 as a whole.

Additionally, the outer peripheral surface 51*c* of the housing 51 is formed with the multiple hole parts 55, a portion of the rotor 52 being exposed through the hole parts 55. Since the coil 80 serving as a hear source is arranged at the outer periphery side c of the rotor 52 in the rotational axis x direction, it is possible to efficiently cool the coil 80.

Other Embodiments

In the above-described embodiment, the explanation has been given for the case of the opening part 43 having the outer peripheral opening part 44 and the end surface opening part 45, but the opening part 43 may have only either one of the outer peripheral opening part 44 or the end surface opening part 45.

Also, the shape of the opening part 43 is not limited to the shape shown in the figures, and may be modified as appropriate. For example, the opening part 43 may be an opening part in a rectangular shape or a round shape not formed extending from the upper end surface 41*a* to the lower end surface 41*b* in the outer peripheral surface 41*c* but formed between the upper end surface 41*a* and the lower end surface 41*b*.

Further, the explanation has been given for the case of the five opening parts 43 being formed along the circumferential direction e of the rotational axis x, but the number of formed opening parts 43 may be modified as appropriate.

Then, in the above-described embodiment, the explanation has been given for the case of the hole parts 55 being formed in the outer peripheral surface 51*c* of the housing 51 by arranging the vertical frames 61*a* and the horizontal frames 61*b* in a lattice shape, but the hole parts 55 may be formed by arranging either of the vertical frames 61*a* or the horizontal frames 61*b* at the outer peripheral surface 51*c*. In other words, the shape and number of hole parts formed in the outer peripheral surface 51*c* of the housing 51 may be modified as appropriate.

Embodiments of the present invention have been explained above, but the present invention is not limited to the air blower 1 according to the above embodiments of the present invention, and includes every mode encompassed by the concept of the present invention and the claims. Also, the configurations may be selectively combined as appropriate to solve or provide at least part of the above-described problems or effects. For example, the shape, material, arrangement, size and the like of the components in the above embodiments may be modified as appropriate in accordance with specific forms of use of the present invention.

LIST OF REFERENCE SIGNS 1 air blower,
3 impeller,
5 motor,
10 case,
10*a* inlet port,
10*b* outlet port,
11 accommodating part,
11*a* top wall part,
11*c* side wall part,

12 bottom part,
12*a* support part,
12*b* cover part,
31 impeller body,
32 first blade,
33 cup,
34 base,
35 upper frame,
36 bottom frame,
41 accommodating part,
41*a* upper end surface,
41*b* lower end surface,
41*c* outer peripheral surface,
41*d* inner peripheral surface,
41*e* protrusion part,
41*f* hole part,
42 second blade,
42*a* intermediate part,
42*b* upper side tip end part,
42*c* lower side rounded end part,
43 opening part,
44 outer peripheral opening part,
45 end surface opening part,
51 housing,
51*a* upper end surface,
51*b* lower end surface,
51*c* outer peripheral surface,
52 rotor,
53 hole part,
54 projection part,
55 hole part,
61*a* vertical frame,
61*b* horizontal frame,
71 frame,
72 inner rotor,
73 stator,
74*a* bearing,
74*b* bearing,
75 shaft,
76 core,
77 magnet,
78 fixing part,
79 stator core,
80 coil,
a upper side,
b lower side,
c outer periphery side,
d inner periphery side,
e circumferential direction,
x rotational axis,
S1 space,
S2 space,
S3 gap

What is claimed is:

1. An air blower comprising:
an impeller; and
a motor, wherein the impeller includes a plurality of first blades, and wherein a cup is arranged inside the plurality of first blades,
the motor includes:
a housing arranged inside the cup,
a stator including a coil, and
an inner rotor arranged inside the stator, wherein
the inner rotor includes a magnet,
a first space is formed between the cup and the housing in a radial direction, and a second space is located between the cup and the plurality of first blades,
an outer peripheral surface of the cup is provided with an opening part facing an outer peripheral surface of the housing in the radial direction
an inner peripheral surface of the cup is provided with a second blade,
the opening part is positioned to provide communication between the second space and the first space,
multiple hole parts formed in the outer peripheral surface of the housing such that the coil is exposed to the first space through the multiple hole parts.

2. The air blower according to claim 1, wherein
the second blade extends in the radial direction from the inner peripheral surface of the cup toward the housing.

3. The air blower according to claim 1, wherein
the cup includes a plurality of opening parts including the opening part, and
the plurality of openings parts are arranged in a circumferential direction.

4. The air blower according to claim 3, wherein
the cup includes a plurality of second blades including the second blade, and
each of the plurality of second blades is adjacent to each of the plurality of opening parts.

5. The air blower according to claim 1, wherein
the cup is provided with an end surface facing the housing in a rotational axis direction,
an end surface opening part is formed in the end surface, and
the end surface opening part in the end surface is continuous with the opening part formed in the outer peripheral surface of the cup.

6. The air blower according to claim 1, wherein
the opening part is formed in the outer peripheral surface of the cup continuously from an end surface facing the housing to a bottom surface.

7. The air blower according to claim 1, wherein
the housing includes an upper end surface and a lower end surface, the outer peripheral surface of the housing is arranged between the upper end surface and the lower end surface.

8. The air blower according to claim 7, wherein
the multiple hole parts are formed in a lattice shape by arranging multiple vertical frames provided between the upper end surface and the lower end surface in a rotational axis and multiple horizontal frames are provided in a middle of the upper end surface and the lower end surface.

* * * * *